US010004290B2

(12) United States Patent
Copeland et al.

(10) Patent No.: US 10,004,290 B2
(45) Date of Patent: Jun. 26, 2018

(54) PROTECTIVE HEADGEAR

(71) Applicant: TWO GUYS AND A HAT INC., Barrie (CA)

(72) Inventors: Steve Arthur Copeland, Barrie (CA); Len Clement, Palgrave (CA); Mitch Thompson, Barrie (CA)

(73) Assignee: TWO GUYS AND A HAT INC., Barrie, Ontario (CA)

( * ) Notice: Subject to any disclaimer, the term of this patent is extended or adjusted under 35 U.S.C. 154(b) by 153 days.

(21) Appl. No.: 14/919,001

(22) Filed: Oct. 21, 2015

(65) Prior Publication Data

US 2016/0157548 A1 Jun. 9, 2016

Related U.S. Application Data

(60) Provisional application No. 62/087,967, filed on Dec. 5, 2014.

(51) Int. Cl.

| | |
|---|---|
| ***A42B 1/20*** | (2006.01) |
| ***A42B 3/32*** | (2006.01) |
| ***A42B 1/02*** | (2006.01) |
| ***A42B 3/04*** | (2006.01) |
| ***A42B 3/22*** | (2006.01) |
| *A42B 1/00* | (2006.01) |

(52) U.S. Cl.

CPC ..... *A42B 3/32* (2013.01); *A42B 1/02* (2013.01); *A42B 3/0406* (2013.01); *A42B 3/227* (2013.01)

(58) Field of Classification Search

CPC .... A42B 1/08; A42B 3/00; A42B 3/10; A42B 3/12; A42B 3/125; A42B 3/06; A42B 3/127; A42B 1/02; A42B 1/06; A42B 1/061; A42B 1/068; A42B 1/069; A42B 1/205; A63B 71/10; A41D 13/015; A41D 13/0012

See application file for complete search history.

(56) References Cited

U.S. PATENT DOCUMENTS

| | | | |
|---|---|---|---|
| 1,378,977 | A | 5/1921 | Parmley |
| 1,852,930 | A | 4/1932 | Hoppe |

(Continued)

FOREIGN PATENT DOCUMENTS

| | | |
|---|---|---|
| DE | 19518961 | 11/1996 |
| GB | 883137 | 11/1961 |
| JP | 3149676 | 4/2009 |

OTHER PUBLICATIONS

Unpublished Patent Application entitled Riding Helmet With Variable Thickness Impact Absorbing Material Providing Improved Appearance, filed on Aug. 24, 2015, listing Ronald S. Friedson as the inventor.

*Primary Examiner* — Bobby Muromoto, Jr.
(74) *Attorney, Agent, or Firm* — Sand & Sebolt

(57) ABSTRACT

A protective headgear for equestrian use provides a traditional style cowboy hat with protective features to allow it to comply with prevailing equestrian helmet standards. The hat includes interior protective padding in the top of the dome, exterior protective padding below the crown of the dome, and exterior protective padding on the rear of the hat below the brim. The protective padding may be secured to the hat by adhesive, stitching, or mechanical fasteners. A chin strap securement system comprising mutually connectable strap-and-buckle assemblies is optionally provided.

22 Claims, 8 Drawing Sheets

(56) References Cited

U.S. PATENT DOCUMENTS 1,894,213 A 1/1933 Ostolaza
2,143,483 A * 1/1939 Iglauer ..... A42B 1/08 2/411
2,333,987 A * 11/1943 Dandy ..... A42B 1/08 2/425
2,391,335 A * 12/1945 O'Brien ..... A42B 3/00 2/425
2,442,052 A * 5/1948 Mauro ..... A42B 1/08 2/412
2,698,434 A 1/1955 Davia
2,717,384 A 9/1955 Frothingham
2,781,517 A 2/1957 Fisher
2,794,189 A 6/1957 Nesbit et al.
2,796,680 A 6/1957 Wittcoff
2,861,270 A 11/1958 McCoy
2,893,014 A 7/1959 Mabry
3,103,015 A * 9/1963 Plastino ..... A42B 1/08 2/422
3,268,911 A * 8/1966 Cox ..... A42B 3/14 2/181.4
3,280,402 A * 10/1966 Scheibchen ..... A42B 3/124 2/414
3,286,275 A 11/1966 Marchello
3,591,863 A * 7/1971 Rickard ..... A42B 3/085 2/415
3,992,721 A * 11/1976 Morton ..... A42B 3/12 2/414
4,345,336 A * 8/1982 Plastino ..... A42B 3/003 2/171.1
4,439,871 A * 4/1984 Plastino ..... A42B 1/08 2/183
4,581,773 A 4/1986 Cunnane
4,619,003 A 10/1986 Asbury
5,226,180 A 7/1993 Leach
5,437,064 A 8/1995 Hamaguchi
5,519,895 A 5/1996 Barnes, Jr.
5,713,083 A 2/1998 King
5,718,004 A 2/1998 Broersma et al.
5,727,250 A * 3/1998 Black ..... A42B 3/227 2/10
5,729,830 A * 3/1998 Luhtala ..... A42B 1/066 2/195.1
5,826,278 A 10/1998 King
5,867,840 A 2/1999 Hirosawa et al.
5,887,289 A * 3/1999 Theoret ..... A42B 1/08 2/195.1
6,012,172 A * 1/2000 Steffy ..... A42B 1/02 2/175.1
6,240,570 B1 6/2001 Wu
6,260,204 B1 7/2001 Morrissey
6,266,827 B1 7/2001 Lampe et al.
6,360,376 B1 3/2002 Carrington
6,374,423 B1 * 4/2002 Anderson ..... A42B 3/227 2/12
6,453,476 B1 9/2002 Moore, III
6,868,560 B2 3/2005 Bostock
6,880,176 B2 4/2005 Timms et al.
6,983,488 B2 1/2006 Foote et al.
7,096,512 B2 * 8/2006 Blair ..... A42B 1/08 2/410
7,103,923 B2 9/2006 Picotte
7,114,194 B2 10/2006 English
D538,513 S 3/2007 Serratelli
7,406,721 B2 8/2008 Husbands et al.
D604,930 S 12/2009 Denny
D637,378 S 5/2011 Cornwell
7,966,673 B1 * 6/2011 Gibson ..... A42B 1/08 2/410
8,060,951 B2 11/2011 Smith
8,205,272 B2 * 6/2012 Green ..... A42B 1/08 2/209.13
8,453,269 B2 6/2013 Hampton, II
8,613,114 B1 12/2013 Olivares Velasco
8,640,267 B1 * 2/2014 Cohen ..... A42B 3/063 2/411
8,763,166 B1 7/2014 Olivares Velasco
8,776,273 B2 7/2014 Krause
8,978,167 B2 * 3/2015 Blair ..... A42B 1/08 2/410
8,997,265 B2 * 4/2015 Olivares Velasco ... A42B 3/125 2/171.1
9,149,085 B2 10/2015 Bryan et al.
D749,307 S 2/2016 Denny
D752,824 S 3/2016 Vito et al.
D768,966 S 10/2016 Denny
2004/0226078 A1 11/2004 Lahman et al.
2007/0000025 A1 1/2007 Picotte
2007/0130673 A1 * 6/2007 Wasserkrug ..... A42B 1/08 2/411
2007/0220663 A1 9/2007 Picotte
2008/0060117 A1 * 3/2008 Timms ..... A42B 1/08 2/171
2008/0083053 A1 * 4/2008 Lin ..... A42B 1/08 2/422
2011/0302697 A1 * 12/2011 Jaquez ..... A42B 1/08 2/209.12
2011/0307997 A1 * 12/2011 Blair ..... A42B 1/08 2/414
2012/0124718 A1 5/2012 Picotte
2012/0131731 A1 5/2012 Motroni
2013/0031701 A1 * 2/2013 Krauter ..... A42B 3/003 2/411
2013/0047323 A1 * 2/2013 Ireland ..... A42B 3/003 2/422
2013/0219593 A1 * 8/2013 Snyder ..... A42B 1/08 2/411
2015/0089725 A1 4/2015 Lowe et al.
2015/0237944 A1 8/2015 Floyd, Jr. et al.
2016/0015104 A1 1/2016 Edwards et al.
2016/0015112 A1 * 1/2016 Bryan ..... A42B 3/0406 2/422

* cited by examiner

PROTECTIVE HEADGEAR

CROSS REFERENCE TO RELATED APPLICATIONS

This application claims priority from U.S. Provisional Application Ser. No. 62/087,967, filed on Dec. 5, 2014; the disclosure of which is entirely incorporated herein by reference.

BACKGROUND

Technical Field

The present disclosure relates generally to protective headgear. More particularly, to improved headgear for equestrian use. Specifically, the present disclosure relates to a protective headgear having the profile of a cowboy hat and the protective functionality of an equestrian helmet.

Background Information

Headgear or helmets are becoming increasingly prevalent in equestrian riding. There is evidence that the use of ASTM/SEI certified helmets save lives and reduce injuries. Many equestrian organizations require the use of helmets. The States of Florida and New York have passed legislation requiring the wearing of helmets for riding. In 2009, the State of Florida mandated helmets for youths under the age of 16. New York has had helmet laws affecting youths under the age of 14 since 1999. The United States Equestrian Foundation (USEF) requires that in classes that mandate a helmet to be worn, that helmet must be ASTM/SEI certified.

However, these helmets are typically the English style that is shunned by Western style riders. The iconic look, fit, and practical sun and rain protection offered by the American cowboy hat still permeates the culture of Western riders. It is common for children to wear these English style helmets while under the supervision of their parents and guardians. As their age, skill, and independence increases, the Western style riders become more concerned with style and emulating the Western rodeo riders who continue to wear a traditional cowboy hat. They abandon their helmets and wear cowboy hats, disregarding their safety and lives, just to maintain this Western tradition.

The cowboy hat, or "western-style hat," is a high-crowned, wide brimmed hat best known as the defining piece of attire for the North American cowboy. Today's cowboy hat has remained basically unchanged in construction and design since the first one was created in 1865 by J. B. Stetson. It is worn by many people and is particularly associated with ranch workers in the Western and Southern United States, Western Canada, and Northern Mexico. It is also popular among country-western singers and North American rodeo participants. It is recognized around the world as part of Old West lore. The shape of a cowboy hat's crown and brim are often modified by the wearer for fashion and to offer better protection against the elements. It is an item of apparel that can be worn in any corner of the world and receive immediate recognition as part of North American cowboy culture.

There have been a few attempts to make a cowboy hat to fit over an equestrian helmet. Troxel, introduced the Western Hat Helmet in 2008. Through the development process, Troxel learned that the helmet portion of the Western hat system could not be made substantially thinner nor smaller and still pass ASTM/SEI certification, even with the most advanced and innovative materials available. This posed a significant challenge as the thickness of the helmet caused the Western hat to look significantly larger when compared to a traditional cowboy hat. As a result, the Western Hat Helmet was not accepted by the equestrian market and has since been discontinued.

One other attempt to provide a western inspired riding helmet is identified in U.S. patent application Ser. No. 14/833,826, filed on Aug. 24, 2015, and claiming the benefit of U.S. Provisional Application Ser. No. 62/041,244, filed on Aug. 25, 2014, entitled "RIDING HELMET WITH VARIABLE THICKNESS IMPACT ABSORBING MATERIAL PROVIDING IMPROVED APPEARANCE" (hereinafter the P-2994 application). The P-2994 application provides a riding helmet having variable thicknesses impact absorbing material providing improved aesthetics with more natural proportions while providing required impact protection. The front and rear of a riding helmet have an interior impact absorbing material that is thicker than an interior impact absorbing material of the opposing sides. Additional impact absorbing material is placed exteriorly on the opposing sides of the riding helmet to provide additional impact protection. In another embodiment, the brim of the riding helmet provides additional impact protection. The exterior impact absorbing material provides impact protection while maintaining the aesthetics and proportions of a riding helmet, and especially a Western style riding helmet. More particularly, the P-2994 application has an internal protective member entirely within a dome portion of a hardened outer protective shell. The P-2994 application includes small protective members, or concha, located exterior the protective shell in spaced apartment increments and sometimes attached to a hatband.

One disadvantage apparent in the P-2994 application is that the outer protective shell resembling a hat (but remarkably is not a regular western hat) is larger than a traditional western-style hat. For example, the entire shell of the application has to be enlarged to provide sufficient coverage for the internal protective member. Notably, the internal protective member varies in thickness at certain locations relative to the wearer's head. For example, the thickness of the internal protective member is thicker at the front and rear portion of the shell and thinner at the left and right side of the shell.

One exemplary need that exists to solve the short-comings of the P-2994 application is that riders want to wear a regular store-bought conventional cowboy hat. Riders want to outfit/convert a store-bought hat into a helmet or piece of protective headgear that can provide sufficient protection and meet ASTM/SEI safety standards.

SUMMARY

The foregoing issues are resolved and an advance in the art is achieved by providing a traditional style cowboy, or western-style, hat with protective features to allow it to pass the ASTM/SEI equestrian helmet standard. In one embodiment, the helmet includes interior protective padding in the top of the dome, exterior protective padding below the crown of the dome, and exterior protective padding on the rear of the hat below the brim. The protective padding may be secured to the hat by adhesive, stitching, or mechanical fastener.

In one aspect, an embodiment of the present disclosure may provide a protective headgear comprising: a hat including a domed portion having an inner surface and an opposed outer surface extending upwardly from a brim; an exterior first protective member exterior the outer surface; an interior second protective member interior the inner surface; and wherein the hat is a cowboy hat.

In another aspect, an embodiment of the present disclosure may provide a protective headgear comprising: a western-style cowboy hat having a 360° brim and an upper dome extending upwardly from the brim; wherein the upper dome is formed from a protective padding; and a shell exterior to the upper dome entirely surrounding the dome.

In another aspect, an embodiment of the present disclosure may provide a method of donning protective headgear comprising the steps of: placing a protective headgear atop a wearer's head, the protective headgear including an external first protective member exterior to a vertically extending sidewall and an interior second protective member interior to the sidewall; and shading all sides of the wearer with a 360° brim extending outwardly from the sidewall. Additionally, this method may include the step of connecting a buckle on strap assembly beneath the wearer's chin, wherein an upper forward end of the strap assembly is coupled adjacent the sidewall and an upper rear end of the strap assembly is couple to a third protective member extending downwardly from the brim.

In yet another aspect, an embodiment of the present disclosure may provide a protective headgear for equestrian use having a traditional style cowboy hat with protective features to allow it to comply with prevailing equestrian helmet standards. The hat includes interior protective padding in the top of the dome, exterior protective padding below the crown of the dome, and exterior protective padding on the rear of the hat below the brim. The protective padding may be secured to the hat by adhesive, stitching, or mechanical fasteners. A chin strap securement system comprising mutually connectable strap-and-buckle assemblies may be optionally provided.

In yet another aspect, an embodiment of the present disclosure may provide a method for converting a full brim hat into protective headgear comprising the steps of providing a full brim hat having a dome extending upwardly from the full brim inserting an internal protective member interior the dome and disposing an annular external protective member exterior the dome above the full brim.

In yet another aspect, an embodiment of the present disclosure may provide a protective headgear kit for converting a full brim hat into protective headgear comprising a full brim hat having a dome extending upwardly from the full brim, an internal protective member interior the dome having a bottom, and an annular external protective member exterior and completely circumscribing the dome above the brim and a portion of the external protective member below the bottom of the internal protective member.

BRIEF DESCRIPTION OF THE SEVERAL VIEWS OF THE DRAWINGS

A sample embodiment of the present disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the present disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
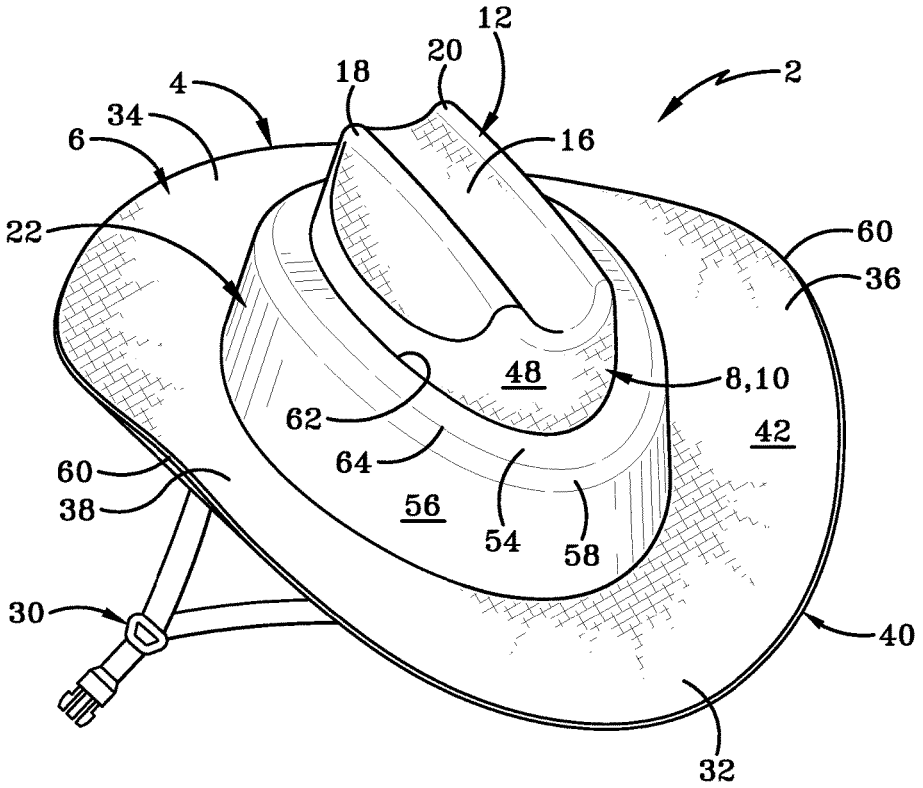
FIG. 1 is a top perspective view of a first embodiment of protective headgear.

The protective headgear of the present disclosure is generally depicted throughout the figures and is indicated generally as 2. The protective headgear 2 includes a hat member 4, a lower brim 6, a dome 8, a sidewall 10, a crown 12, an uppermost U-shaped portion 16, a first convex connector portion 18, a second convex connector portion 20, external first protective padding member 22, internal second protective padding member 24, a rear third protective padding member 26, a head band 28, and a strap and buckle assembly 30.

Figure 2:
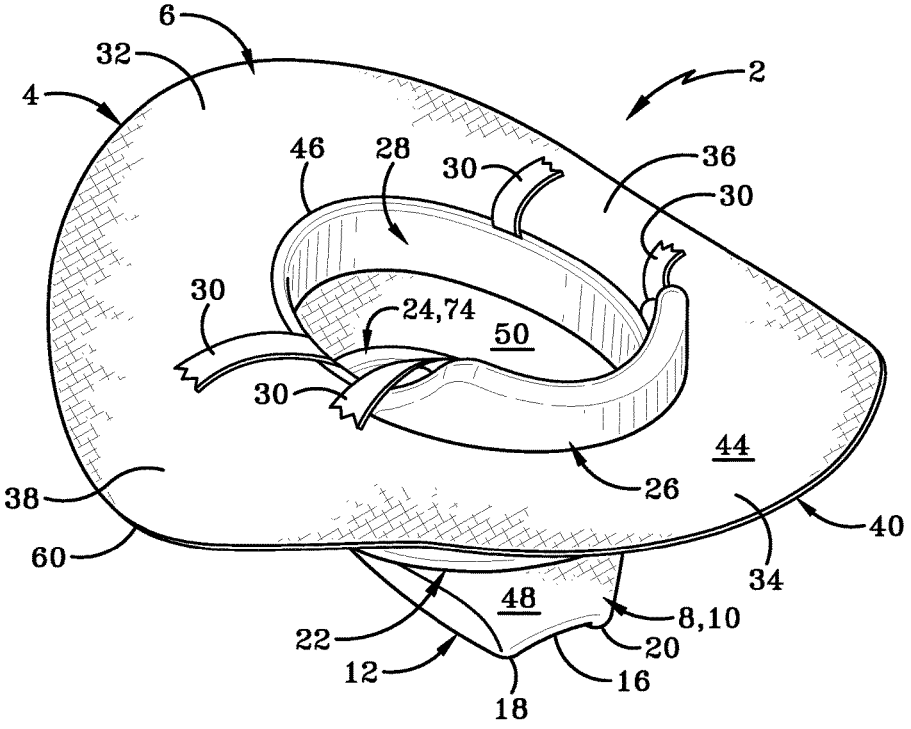
FIG. 2 is a bottom perspective view of the first embodiment.
Figure 3:
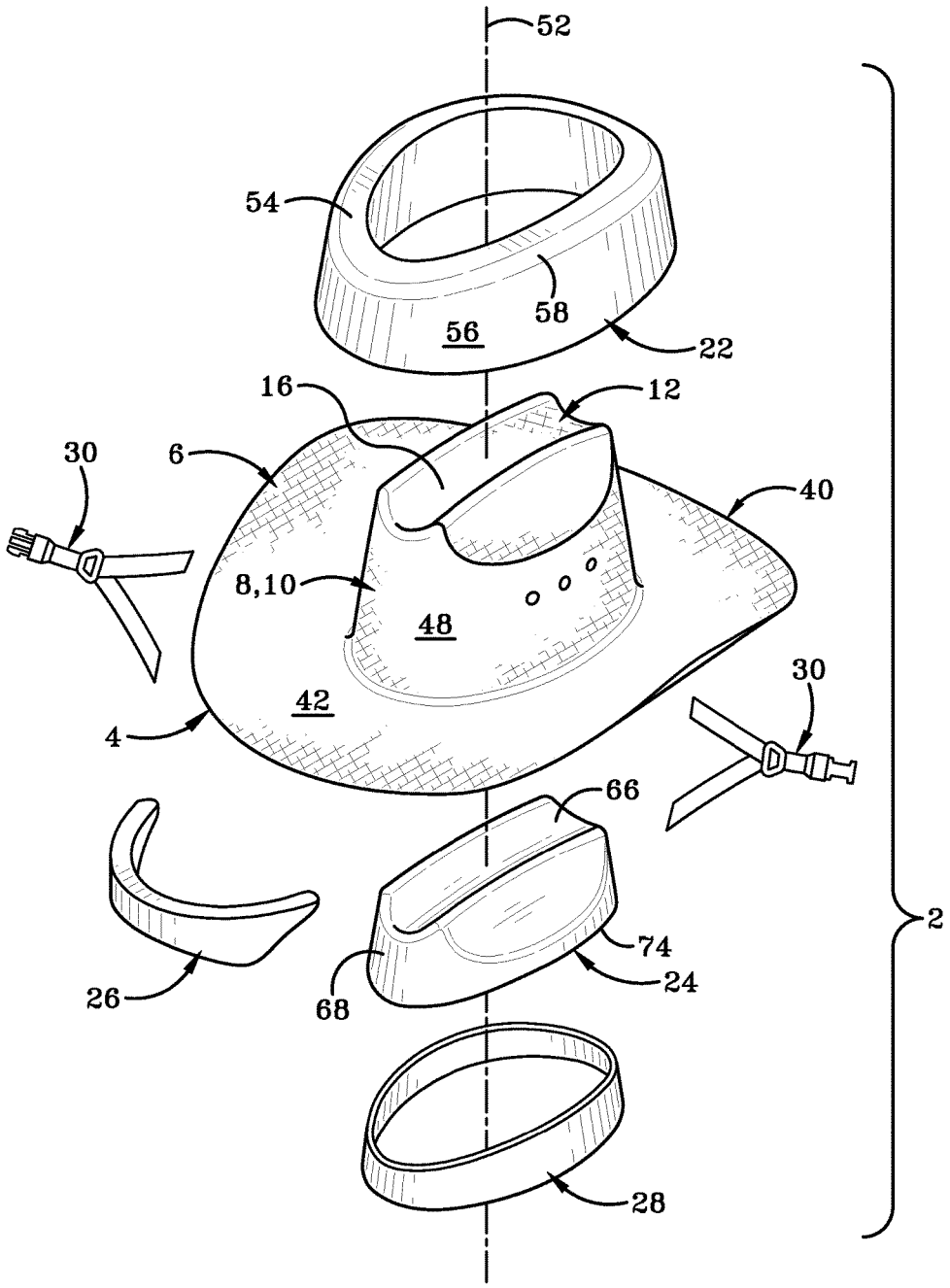
FIG. 3 is an exploded perspective view of the first embodiment.

Turning now to the drawings wherein like reference numerals indicate like elements in all of several views, FIG. 1 through FIG. 3 illustrate protective headgear 2 that addresses the need for protective headgear for Western style equestrian riders. The protective headgear 2 includes hat 4 having continuous lower brim 6 and dome 8. Continuous lower brim 6 includes a front portion 32 opposite a rear portion 34 that define a longitudinal direction therebetween. Longitudinal direction extending between front portion 32 and rear portion 34 lies coplanar with the sagittal plane a person (i.e. wearer "W") wearing protective headgear 2. Lower brim 6 further includes a left portion 36 spaced apart and opposite a right portion 38 that define a transverse direction therebetween. The transverse direction associated with the left and right sides 36, 38 of continuous lower brim 6 are designed to be coplanar with the coronal plane of the wearer W wearing protective headgear 2. Lower brim 6 includes an outer edge 40 spaced opposite an inner edge that define a upwardly facing top surface 42 and a downwardly facing bottom surface 44. When viewed from above, outer edge 40 of lower brim 6 forms a generally curved profile and in one particular embodiment outer edge 40 is a continuous outer edge having a generally oval or generally round profile when viewed from above. Outer edge 40 of brim 6 extends 360° around an imaginary center axis 52. As is customary with many cowboy or western style hats, left portion 36 and right portion 38 may curve arcuately upward such that upwardly facing top surface 42 is generally concave along left portion 36 and along right portion 38. Similarly, downwardly facing bottom surface 44 may be convexly curved along left portion 36 and the bottom surface 44 may be convexly curved along right portion 38. Lower brim 6 is a continuous structure having a generally annular shape configured to circumscribe the head of the wearer W such that the brim 6 provides shade to the wearer's face, the wearer's left side, the wearer's right side, and the back of the wearer's neck.

The dome portion 8 has a sidewall 10 extending upward from the brim. Sidewall 10 extends from a connection with an inner annular edge 46 and extends vertically upward away from upper surface 42 towards the uppermost U-shaped portion 16. Sidewall 10 is generally cylindrical having a radially outwardly facing outer surface 48 opposite a radially inwardly facing inner surface 50 relative to a vertical central axis 52. Stated otherwise, sidewall 10 is aligned with the vertical central axis 52 but does not intersect the vertical axis 52 and the outer surface 48 faces away from vertical axis 52 and inner surface 50 faces vertical axis 52.

In one particular embodiment, the bottom portion of sidewall 10 meets an inner annular portion of brim 6 at inner annular edge 46 forming approximately a right angle when viewed in cross section. The crown 12 at the top of the dome forms convoluted corrugations, including the uppermost U-shaped portion 16, which is lengthwise forwardly elongated and downwardly concave, and two upwardly convex connector portions 18 and 20. It is understood that although the overall configuration of the illustrated embodiment of the hat 4 resembles that of a Stetson hat, it could be any one of a plurality of configurations of a traditional cowboy hat. The hat 4 can be made of any suitable hat material, including felt, cloth, fur, leather, or straw material of the type normally used in hat construction. The hat 4 can be made in exactly the same size, shape, and materials that existing traditional cowboy hats are made of. This allows the protective headgear 2 to look, fit, and feel exactly the same as traditional cowboy hats.

The external protective padding, also referred to as an annular exterior first protective member, 22 may be attached with adhesive or mechanical fasteners to the sidewall 10 of the dome 8 of hat 4. It is understood that although the illustrated embodiment of the external padding 22 is shown as a continuous annular ring covering the entire sidewall 10, this external protective padding 22 could be made from a plurality of separate pieces. This external protective padding 22 could be made with any suitable cushioning material, such as expanded polystyrene foam, preferably of suitable thickness to meet or exceed prevailing headgear certification impact requirements. The external protective padding 22 may be covered with an outer impact-resistant shell made from any suitable impact-resistant material such as molded ABS plastic. The external protective padding 22 could also be covered with felt, cloth, leather, or some other decorative material. This external protective padding 22 may include cooling vent holes formed through the cushioning material and the outer impact-resistant shell.

More particularly, external protective padding 22 includes an upwardly facing top surface 54 and a radially outward facing generally planar vertical sidewall surface 56 and a rounded or chamfered edge 58 connecting the top surface 54 with radially outwardly facing vertical sidewall surface 56. Relative to other components of protective hat 4, top surface 54 is vertically lower than uppermost U-shaped portion 16 and vertically higher than upwardly facing top surface 42 on brim 6. In some implementations, top surface 54 may be vertically higher than an apex 60 on each of the left portion 36 and right portion 38 of brim 6.

When viewing the external protective member 22 in cross section, the external protective member 22 has a frustoconically shaped profile such that the vertically lower portion 55 of external protective member 22 has a greater diameter relative to vertical central axis 52 than the diameter associated with the external protective member 22 near the vertically uppermost portion 57 of the external protective member 22. Stated otherwise, sidewall 22 may slightly taper from bottom to top of external protective member 22. There may be other implementations where external protective member 22 is generally orthogonal relative to the upwardly facing top surface 42 of brim 6.

Top surface 54 of external protective member 22 lies along a plane that is generally parallel to and offset above the plane associated with continuous lower brim 6 adjacent front portion 32. Top surface 54 may be bound by an inner edge 62 and an outer edge 64 which defines an upper portion of chamfer 58. Note, instead of a chamfered edge 58, the edge may be rounded. Top surface 54 adjoins sidewall 10 at inner edge 62 and in one particular embodiment an obtuse angle defined between top surface 54 and the radially outwardly facing outer surface 48 of sidewall 10. Similar to other alternative embodiments, rather than an obtuse angle, the angle extending between top surface 54 and outer surface 48 may be a right angle or even an acute angle.

Exterior protective member 22 may have a thickness measured from outer surface 56 radially inward towards vertical center axis 52 and terminating at an inner vertical surface flushly adjoining sidewall 10. This may also be referred to as the radial thickness of external protective member 22 relative to vertical axis 52. The thickness of external protective member 22 may be in a range from about 10 mm (about 0.4 inches) to about 30 mm (about 1.2 inches). More particularly, the thickness of external protective padding 22 may be in a range from about 15 mm (about 0.6 inches) to about 25 mm (about 1 inch). In one particular embodiment, the external protective padding 22 thickness is about 19 mm (about 0.75 inch).

Exterior protective member 22 generally has a thickness, as described above, that is uniform at all points circumscribing the outside of sidewall 10 on the hat. Stated otherwise, the thickness of the exterior protective member outside sidewall 10 is the same at both the forward end, the rear end, a left side, and a right side. Note that the thickness is measured at a single vertical height at all points circumscribing a wearer's head but that the slightly tapering effect of external protective member 22 may have a varying thickness from the lower portion of external protective member 22 to the uppermost portion 57 of the external protective member 22, as stated above.

Exterior protective member 22 and interior protective member 24 are preferably formed from expanded polystyrene (EPS) foam. However, other materials are entirely possible that can suitably form members 22, 24, and third member 26 for sufficient impact protection, such as, die cut ethylene vinyl acetate (EVA) foam or cross-linked polyethylene (PE) foam.

Figure 6:
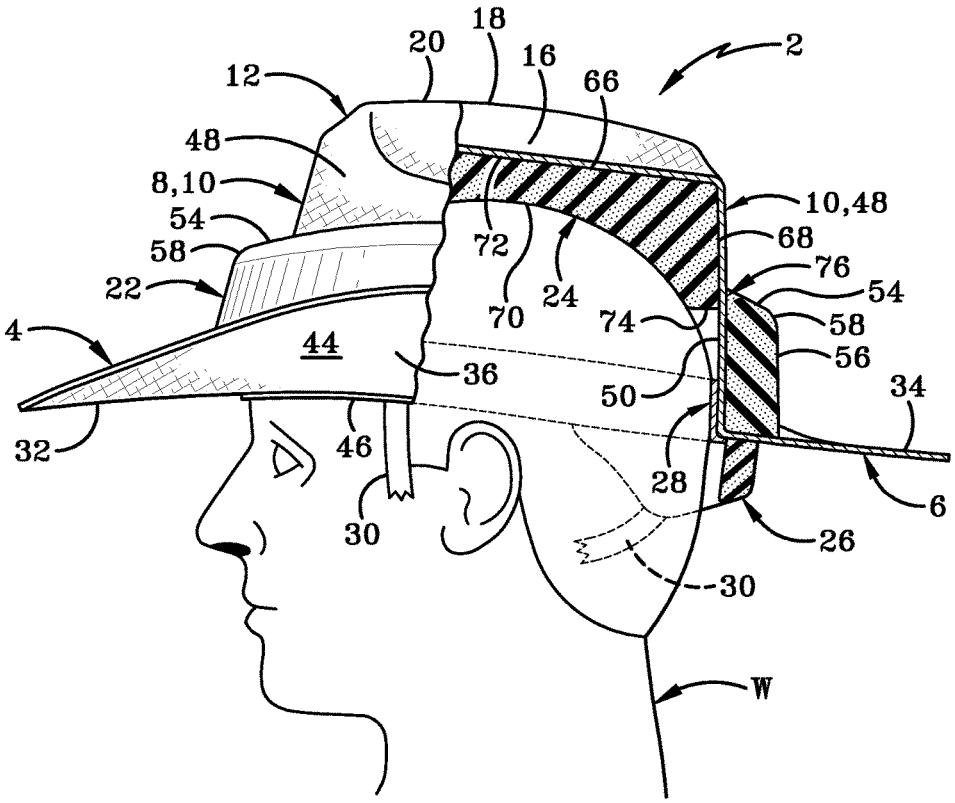
FIG. 6 is a left side elevation view depicting a partial cross-section detailing interior portions of the first embodiment.

Protective headgear 2 also includes internal protective padding, also referred to as an interior second protective member 24. The internal protective padding 24 may be attached with adhesive or fasteners to the sidewall 10 or to the crown 12 of the dome 8 of hat 4 of headgear 2. It is to be understood that although the illustrated embodiment of the internal protective padding 24 is shown as a single piece filling the space between the head of the wearer W and the dome 8, as shown in FIG. 6, this internal protective padding 24 could be made from a plurality of separate pieces. This internal protective padding 24 could be made with any suitable cushioning material, such as expanded polystyrene foam. The internal protective padding 24 may be covered with an impact resistant shell between the padding and the dome 8 and be made from any suitable impact-resistant material such as molded ABS plastic. This internal protective padding 24 may include cooling vent holes formed through the cushioning material and the outer impact-resistant shell. The internal protective padding 24 may also have comfort padding or fabric on the bottom side of the cushioning material to provide added comfort and sweat absorption or wicking away from the wearers head.

Additionally, interior protective padding 24 includes an upwardly facing top surface 66, a generally vertical tapering sidewall 68, and a downwardly facing convex bottom surface 70. As depicted in FIG. 3, the upper portion 66 of internal protective member 24 is shaped complementary to an inner surface 72 of the uppermost U-shaped portion 16. The upper portion 66 may directly adjoin and abut against inner surface 72 of uppermost portion 16. In some embodiments, the inner member 24 may be adhered or otherwise permanently secured to the hat via adhesive adjoining the inner protective member 24 to the uppermost portion 16. The tapered sidewalls 68 of inner protective member 24 are shaped complementary to inner surface 50 of tapering sidewall 10 such that inner protective member 24 has frustoconically shaped sidewalls 68 when viewed in cross section such as depicted in FIG. 6. The downwardly facing convex bottom surface 70 is configured to receive and nest atop the wearer's W head.

Interior protective member 24 is preferably centered along vertical axis 52 and nests within cavity defined by hat 4 in a manner such that a front portion of inner protective member 24 aligns closely adjacent a forward portion of dome 8 and a rear portion of inner protective member 24 closely aligns with a rear portion of dome 8.

Figure 4:
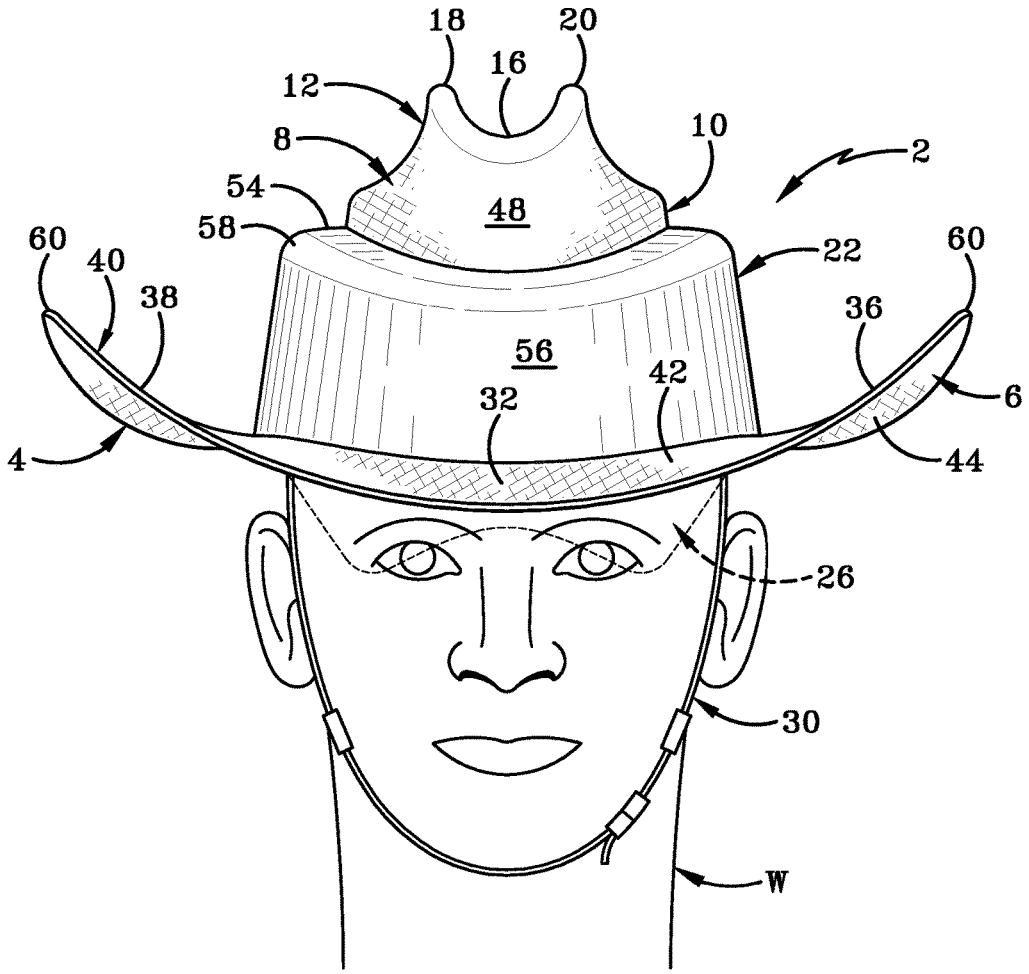
FIG. 4 is a front elevation view of the first embodiment worn by a wearer.
Figure 5:
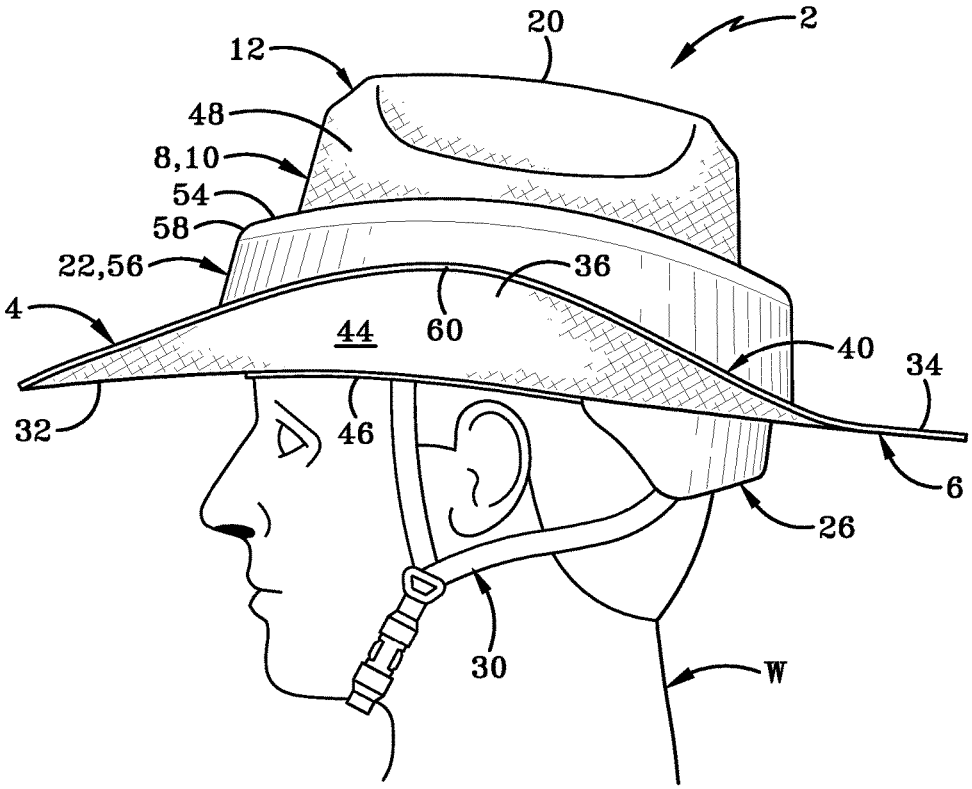
FIG. 5 is a left side elevation view of the first embodiment worn by a wearer.

FIG. 4 and FIG. 5 show the protective headgear 2 on the head of a wearer W. These views depict that the internal protective padding 24 is not visible and the external protective padding 22 provides very little change to the size or shape of the traditional style cowboy hat while allowing the hat to meet or exceed prevailing headgear certification impact requirements.

As shown in the partial cross-section view of FIG. 6, the external protective padding 22 would overlap or come close to the internal protective padding 24 near region 76 to provide continuous protection over the entire dome 8 of hat 4. This preferably allows the conventional hat 4 to meet or exceed prevailing headgear certification impact requirements. More particularly, internal protective member 24 includes a downwardly facing bottom edge or lowermost portion 74 annularly circumscribing the wearer's head defining a lowermost end of internal protective member 24. The lowermost portion 74 of internal protective member 24 terminates at a vertical height closely adjacent top surface 54 of external protective member 22. This may be referred to as a protective transition region 76. The general protective transition region 76 may have a slight vertical overlap in relative height where the upper top surface 54 of external member 22 is slightly vertically higher than the lowermost portion 74 of internal protective member 24. In some other embodiments, the lowermost portion 74 of internal protective member 24 may be at a vertically equal height with the upper top surface 54 of external protective member 22. Lowermost portion 74 is disposed on an opposite side of vertical sidewall 10 than top surface 54 of external protective member 22. Lowermost portion 74 is closer to the vertically extending center axis 52 than the upper top portion 54 which is radially farther away from center axis 52.

With continued reference to FIG. 6, bottom edge 74, which also may be referred to as the lowermost portion 74 of interior protective member 24, has a thickness that is generally uniform at all points circumscribing the wearer's head. Additionally, edge 74 terminates vertically above the upwardly facing top surface 42 of brim 6.

The protective headgear 2 may include a rear protective pad, also referred to as a third protective member 26 located below the brim 6 of hat 4 to add additional protection. The rear protective pad 26 could be made with any suitable cushioning material, such as expanded polystyrene foam. The rear protective padding 26 may be covered with an outer impact-resistant shell made from any suitable impact-resistant material such as molded ABS plastic. It could also be covered with cloth, felt, leather, or some other decorative material. The rear protective padding 26 could be attached to the brim 6, dome 8, or head band 28 of the hat 4 by stitching, adhesive, or mechanical fasteners.

The protective hat may also include a chin strap securement system comprising mutually connectable strap-and-buckle assemblies 30 secured to the hat 4 between the head band 28 and the hat 4. Preferably, this configuration would be made with materials to allow the protective headgear 2 to meet or exceed prevailing headgear certification retention and roll off requirements.

Like traditional hats, the protective headgear 2 would be available in many sizes and styles. Typically, hat sizes range from a size 6⅝ to a size 8 which fit head circumferences from about twenty-one inches to about twenty-five and a half inches. There are a wide variety of cowboy hat styles with varying shapes of creases and dents in the dome. To reduce the number of sizes required for the external protective padding 22 and the internal protective padding 24 to fit the hat 4, the protective padding could be made from a plurality of pieces that can be adjusted during assembly to fit around and inside the dome 8 of the hat 4.

Accordingly, a protective headgear has been disclosed. Advantageously, the protective hat provides wearers with the ability to wear a traditional cowboy hat 4 with its iconic look, fit, and practical weather protection. It also has the added impact protection of a helmet certified to the ASTM/SEI equestrian standard. Western riders will now embrace the protection of a helmet to save lives and reduce injuries. No longer will helmets be abandoned by Western style riders as they continue to maintain the tradition of the West.

Figure 7:
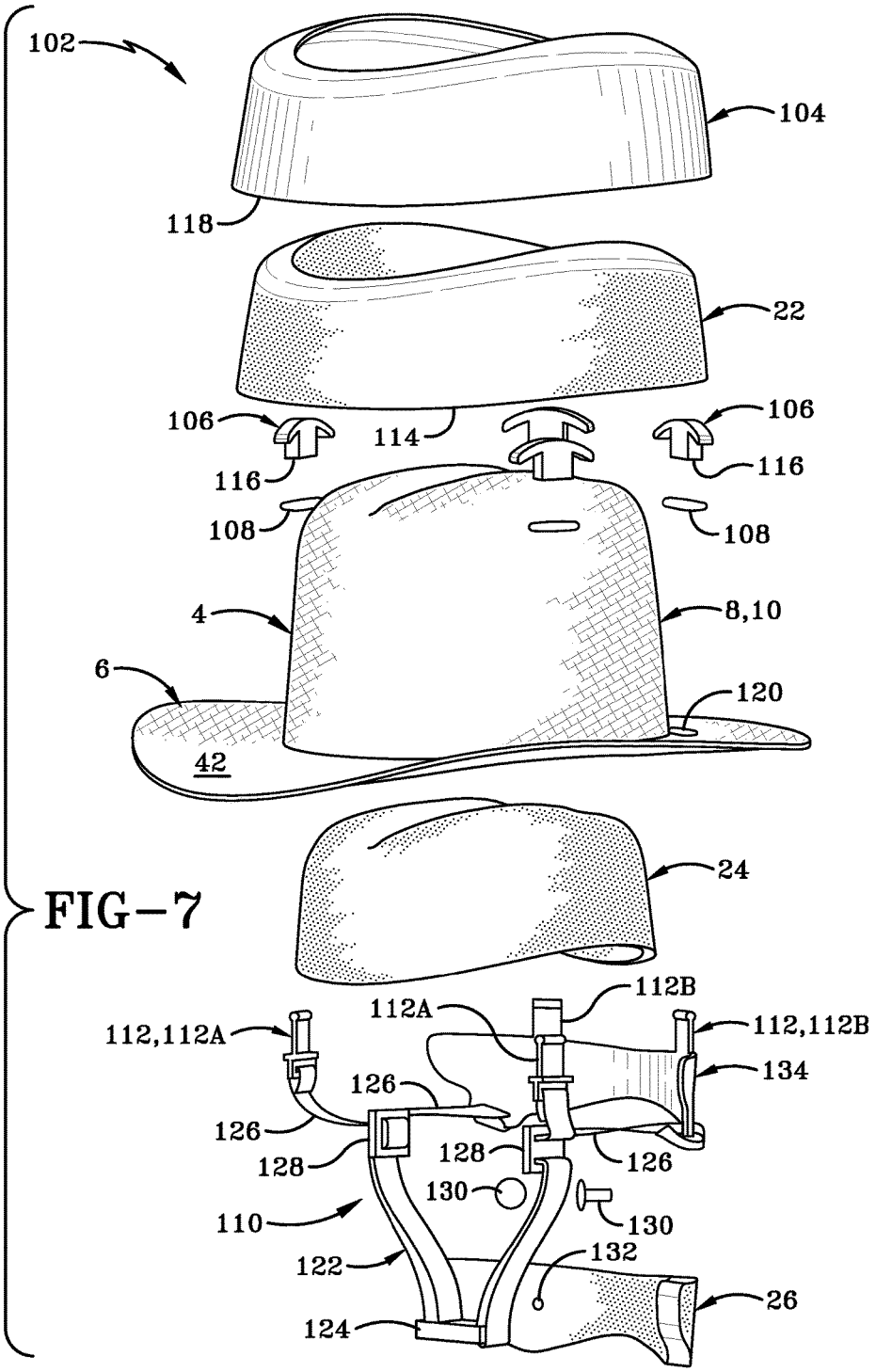
FIG. 7 is an exploded perspective view of a second embodiment.

As depicted in FIG. 7, a second embodiment of a protective headgear is shown generally as 102 in an exploded view to more completely detail the various components of headgear 102. Particularly, headgear 102 may include external first protective padding member 22, internal second protective padding member 24, a rear third protective padding member 26, hat 4, outer shell 104, a first connection member 106, a grommet 108, a strap assembly 110 having second connection members 112. The external first protective member 22 rests above brim 6 similar to that of protective headgear 2. A bottom side 114 of protective member 22 may engage the upwardly facing top surface 42 of brim 6. The first connection member 106 may be integrally formed with annular external protective member 22 such that they are recessed within the annular ring of external protective member 22 and the bottom side 116 of member 106 is flush with bottom 114. First connection members 106 define a hollow interior cavity (not shown) configured to receive second connection member 112 as will be described in greater detail below. Bottom 116 of first connection member 106 aligns with grommet 108 and aperture 120 formed in brim 6. External shell 104 surrounds and covers padding 22 and has a bottom edge 118 that lies flush with bottom edge 114 in the assembled position such that the bottom 118 of external shell 104 contacts the upwardly facing top surface 42 of brim 6. The shell 104 may be formed from an impact resistant material such as molded ABS plastic. Shell 104 may have thickness of approximately 2 mm but could be in a range from about 0.25 mm to about 4 mm. Alternatively, shell 104 may be formed from a polycarbonate vacuum formed film 0.5 mm thick.

With continued reference to FIG. 7, strap assembly 110 includes second connection members 112, a chin strap 122 having a buckle 124, and an upper portion 126 that is adjustable in length via member 128. A rear plate connector 134 connects strap assembly 110 to third protective member 26 via button connectors 130 extending through an aperture 132 formed in third member 26. More particularly, forwardmost connection members 112A are connected to upper portion 126 and rearmost second connectors 112B are part of the plate connector 134. Each of the second connection members, 112A and 112B, are inserted into first connectors 106 in the assembled position.

Figure 8:
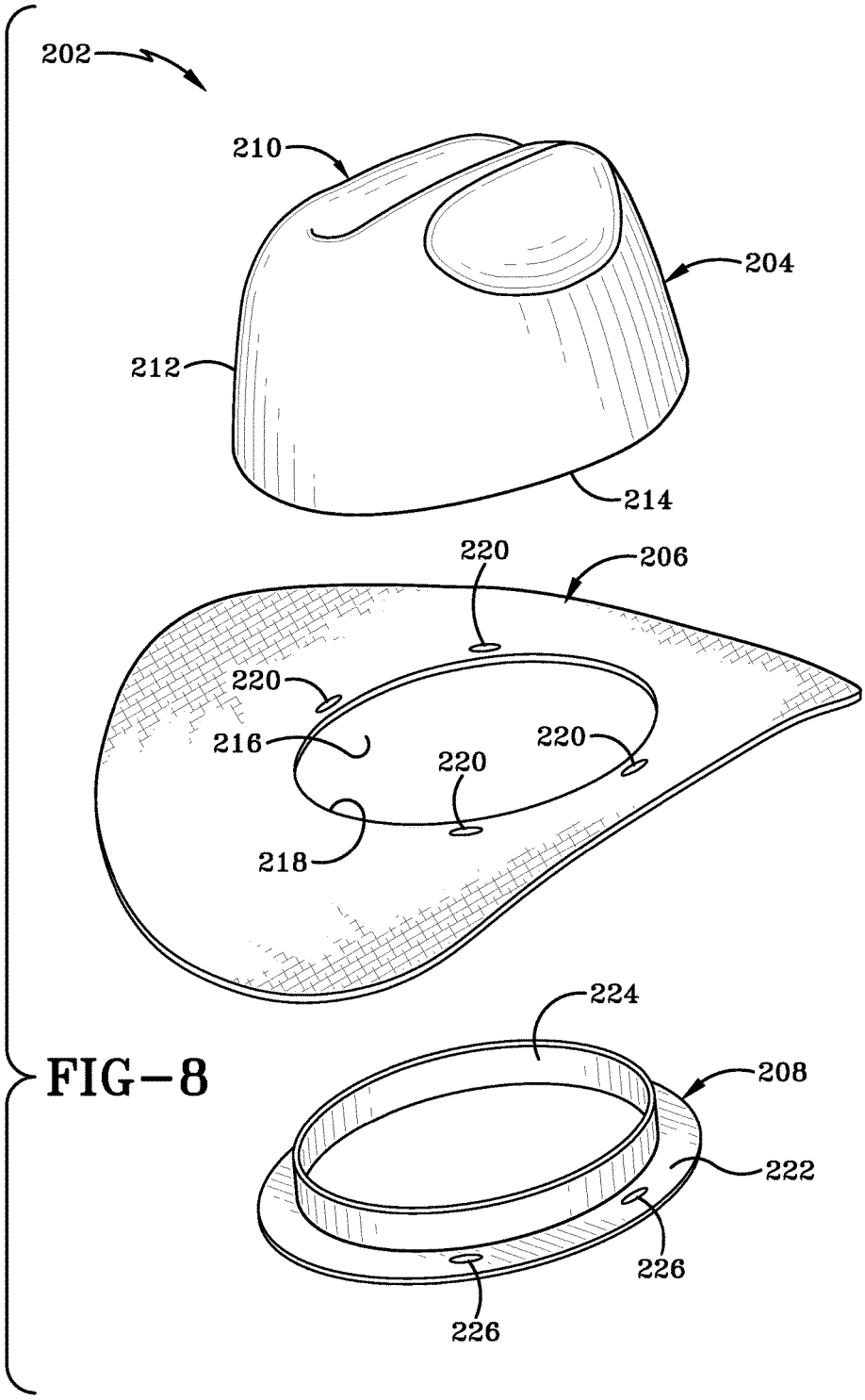
FIG. 8 is an exploded perspective view of a third embodiment.

As depicted in FIG. 8, a third embodiment of the protective headgear of the present disclosure is generally indicated at 202. Protective headgear 202 includes a protective upper portion 204, a brim 206, and a ring frame 208. Protective upper portion 204 includes an upwardly facing domed top 210 and a sidewall 212 extending downwardly therefrom to a lower generally circular or oval edge 214. Protective upper portion 204 includes a downwardly concave recessed area (not shown) configured to receive the top of the wearer's W head when third embodiment of protective headgear 202 is assembled and worn. Protective upper portion 204 may be formed of a protective material similar to that of external padding 22 and internal padding 24. Brim 206 may be formed similar to that of brim 6 defining an inner opening 216 defined by inner edge 218. External to inner edge 218 are a plurality of apertures 220 formed through the brim 206. Apertures 220 align with similar apertures (not shown) formed in the downwardly facing bottom surface adjacent bottom edge 214 of upper protective member 204.

Ring frame 208 includes horizontal leg 222 and a vertical leg 224 connecting to each other at approximately a right angle. Vertically aligned apertures 226 are formed through horizontal leg 222. In the assembled position, vertical leg 224 extends upwardly through opening 216 and into upper portion 204. The bottom surface of brim 206 engages the upwardly facing top surface of leg 222 and aperture 226 aligns with apertures with 220. Aligned apertures 220, 226 allow for the passage of a connection member, such as a screw, to connect the upper portion 204 to frame 208 sandwiching brim 206 therebetween.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the present disclosure are an example and the present disclosure is not limited to the exact details shown or described.

What is claimed:

1. A protective headgear comprising:

an annular exterior first protective member adapted to fully circumscribe exterior an outer surface on a full brim hat;

an interior second protective member adapted to be interior the outer surface;

a first connector coupled with the annular exterior first protective member;

an aperture formed in the full brim; and a strap assembly including a second connector for connecting with the first connector, wherein when the second connector is connected with the first connector, a portion of the strap assembly extends through the aperture formed in the full brim hat.

2. The protective headgear of claim 1, further comprising:

an imaginary vertically extending center axis;

a grommet defining the aperture and secured to the full brim;

the second protective member closer to the center axis than the first protective member; and wherein the first connector is integrally formed within the annular exterior first protective member and vertically aligned with the aperture formed in the full brim hat to connect with the second connector of the strap assembly extending through the aperture.

3. The protective headgear of claim 2 wherein the annular exterior first protective member is entirely outward from the interior second protective member relative to the vertically extending center axis, and wherein the first connector is integrally formed within the first protective member such that a bottom of the first connector aligns flush with a bottom of the first protective member, and the first connector is disposed vertically above the grommet.

4. The protective headgear of claim 2, wherein the second protective member intersects the center axis and the first protective member does not intersect the center axis.

5. The protective headgear of claim 1, further comprising:

an upper surface on the interior second protective member;

the upper surface positioned at a greater height than that of the annular exterior first protective member;

the first connector recessed within the annular exterior first protective member above the aperture formed in a grommet secured to the full brim hat; and the second connector on the strap assembly extends through the aperture to connect with the first connector.

6. The protective headgear of claim 5, further comprising:

a bottom surface on the interior second protective member, wherein the bottom surface is at a height above a portion of the annular exterior first protective member;

a top surface and a bottom surface on the full brim; and a portion of the second connector positioned above the top surface on the full brim and a portion of the second connector positioned below the bottom surface on the full brim when the second connector extends through the aperture and is connected with the first connector.

7. The protective headgear of claim 1, wherein the full brim hat includes a generally cylindrical sidewall extending upwardly to a generally domed portion, wherein the first protective member is exterior the sidewall and the second protective member is interior the sidewall, and the hat includes an upwardly facing top surface on the full brim, wherein the first connector is recessed within the first protective member aligns flush with the upwardly facing surface on the full brim and a grommet, and a portion of the strap assembly that extends through the aperture formed in the full brim hat connects with the first connector, and wherein the second connector is disposed within the first protective member above the full brim when connected to the first connector.

8. The protective headgear of claim 7, wherein the interior second protective member includes:

a top surface shaped complementary to an inner surface of the domed portion and nestingly adjoining therebeneath; and a downwardly concave bottom surface spaced apart and below the top surface and adapted to rest atop a wearer's head;

wherein the downwardly concave bottom surface is entirely above the grommet connected with the full brim, and the grommet arranged substantially horizontal on the full brim.

9. The protective headgear of claim 8, wherein the interior second protective member further includes a sidewall tapering from the top surface to the bottom surface.

10. The protective headgear of claim 9, wherein the sidewall is planar in cross-section.

11. The protective headgear of claim 7, wherein the annular exterior first protective member includes:

an upwardly facing top surface spaced from a downwardly facing bottom surface engaging the full brim, and having an outwardly facing first sidewall spaced from a second sidewall engaging the outer surface of the domed portion, wherein the grommet is disposed between the first sidewall and the second sidewall; and a hollow interior cavity is formed between the first sidewall and the second sidewall, and the first connector recessed within the hollow interior cavity for connecting with the second connector on the strap assembly.

12. The protective headgear of claim 11, further comprising:

a lower end on the downwardly concave bottom surface terminating at a height similar to that of the upwardly facing top surface on the annular exterior first protective member.

13. The protective headgear of claim 12, further comprising:

a protective transition region having a slight vertical overlap in relative height of the top surface of the exterior first protective member to the lower end of the interior second protective member.

14. The protective headgear of claim 12, further comprising:

a thickness of the annular exterior first protective member measured from the first sidewall to the second sidewall;

a height of the annular exterior first protective member measured from the top surface to the bottom surface; and wherein the thickness of the annular exterior first protective member is greater than the height of the annular exterior first protective member, and the annular exterior first protective member.

15. The protective headgear of claim 12, further comprising:

an imaginary vertically extending central axis and the hat centered about central axis;

an outer edge of the brim;

a first radius measured from the central axis to the outer edge of the brim; and a second radius measured from central axis to the first sidewall of the first protective member less than the first radius.

16. The protective headgear of claim 8, further comprising;

a rear end on the cylindrical sidewall of the hat; and a third protective member extending downwardly below the brim beneath the rear end on the cap portion.

17. The protective headgear of claim 8, wherein the brim includes:

a left side opposite a right side;

a first apex at the left side defining a uppermost portion of the brim;

a second apex at the right side at an equal height as the first apex; and the first and second apexes above the top surface on the exterior second protective member.

18. The protective headgear of claim 17, further comprising an external impact resistant shell surrounding the exterior first protective member formed from a different material than that of the exterior first protective member, and the impact resistant shell having a thickness in a range from about 0.25 mm to about 4 mm.

19. The protective headgear of claim 7 further comprising an external shell covering the generally domed portion of the full brim hat.

20. The protective headgear of claim 19 further comprising a bottom edge of the external shell adjoining an upwardly facing top surface of the brim.

21. A method for converting a full brim hat into protective headgear comprising the steps of:

providing a full brim hat having a dome extending upwardly from the full brim;

inserting an internal protective member interior the dome;

disposing an annular external protective member exterior the dome above the full brim;

positioning a lower end on the internal protective member to terminate at a height similar to that of a top surface on the annular external protective member; and connecting a first connection member recessed within the annular external protective member with a second connection member on a strap assembly through an aperture formed in full brim hat.

22. A protective headgear kit for converting a full brim hat into protective headgear comprising:

a full brim hat having a dome extending upwardly from the full brim and the dome and full brim are adapted to approximate a configuration of one of a western-style hat and a cowboy hat, and a first vertically aligned aperture defined in the full brim on a first side of the hat and a second vertically aligned aperture defined in the full brim on a second side of the hat;

an internal protective member interior the dome having a bottom;

an annular external protective member exterior and completely circumscribing the dome above the brim and a portion of the external protective member below the bottom of the internal protective member;

a rear protective member positioned lower than the internal protective member and lower than the external protective member;

a first connection member recessed within the annular external protective member; and a second connection member on a strap assembly extending through the first vertically aligned aperture and a portion of the strap assembly connected with the rear protective member.

* * * * *